United States Patent [19]

Doi et al.

[11] 4,073,618

[45] Feb. 14, 1978

[54] ANTI-CORROSIVE AGENT FOR METALS

[75] Inventors: Tsunesuke Doi, Tama; Hiroshi Komoto, Yokohama; Masazumi Chono, Yokohama; Akira Inoue, Yokohama; Kazuaki Saito, Chigasaki; Isao Shinozuka, Kawasaki, all of Japan

[73] Assignee: Asahi Kasei Kogyo Kabushiki Kaisha, Osaka, Japan

[21] Appl. No.: 774,631

[22] Filed: Mar. 4, 1977

Related U.S. Application Data

[62] Division of Ser. No. 667,622, March 17, 1976, Pat. No. 4,028,055.

[30] Foreign Application Priority Data

Mar. 19, 1975 Japan ..... 50-33392

[51] Int. Cl.[2] ..... C09K 3/00; C23F 11/04; C23F 11/06; C23F 11/10; C23G 1/06; C23G 1/18; C23G 1/26

[52] U.S. Cl. ..... 21/2.7 R; 106/14; 252/8.55 E; 252/148; 252/390; 252/392; 260/558 R; 260/559 S; 260/559 R; 260/561 B; 260/561 R; 260/583 P

[58] Field of Search ..... 252/8.55 E, 148, 390, 252/392; 21/2.7 R; 106/14; 260/583 P; 260/558 R, 559 S, 559 R, 561 B, 561 R

[56] References Cited

U.S. PATENT DOCUMENTS

| | | | |
|---|---|---|---|
| 2,532,277 | 12/1950 | Castle | 260/583 P |
| 2,765,306 | 10/1956 | England | 260/583 P |
| 3,265,512 | 8/1966 | Dickson | 252/390 |
| 3,382,186 | 5/1968 | Silverstein | 252/390 |
| 3,770,377 | 11/1973 | Scott et al. | 252/392 |
| 3,930,810 | 1/1976 | Gattuso | 252/392 |
| 3,962,122 | 6/1976 | Trial | 252/392 |

FOREIGN PATENT DOCUMENTS

| | | | |
|---|---|---|---|
| 2,199,545 | 4/1974 | France | 260/583 P |
| 4,945,998 | 5/1974 | Japan | 260/583 P |
| 49-128099 | 12/1974 | Japan | 260/583 P |
| 4,948,799 | 5/1974 | Japan | 260/583 P |
| 5,098,932 | 8/1975 | Japan | 260/583 P |
| 50-112498 | 9/1975 | Japan | 260/583 P |
| 50-112495 | 9/1975 | Japan | 260/583 P |
| 50-111196 | 9/1975 | Japan | 260/583 P |
| 1,387,394 | 3/1975 | United Kingdom | 260/583 P |

*Primary Examiner*—Benjamin R. Padgett
*Assistant Examiner*—T. S. Gron
*Attorney, Agent, or Firm*—Armstrong, Nikaido & Marmelstein

[57] ABSTRACT

A method of inhibiting corrosion of metals comprising applying to a metal surface in an effective concentration a saturated aliphatic triamine of 9 carbon atoms having at each terminal position a primary amino group and being branched in the 4-position of the main chain Such specific triamines include 1,3,6-triaminomethylhexane and 1,2,3-triaminoethylpropane. Addition products and condensation products derived from these organic triamines are also effective. The present anti-corrosive agents show a remarkable rust preventive effect to metals even when used in a small amount and are non-toxic.

13 Claims, No Drawings

ANTI-CORROSIVE AGENT FOR METALS

This is a division of application Ser. No. 667,622, Filed Mar. 17, 1976, now U.S. Pat. No. 4,028,055.

This invention relates to an anti-corrosive agent for metals. More particularly, the invention relates to a novel anti-corrosive agent for metals comprising as an active component an organic triamine or a derivative thereof.

It is known that as water-soluble and oil-soluble rust preventing agents or anti-corrosive agents for metals, there can be used inorganic compounds such as chromates and phosphates, alkylamines, polyalkylamines, condensation products of carboxylic acids such as higher alkyl saturated or unsaturated monocarboxylic acids and polycarboxylic acids with amines such as alkylamines and polyalkylamines, and addition products of alkylene oxides to amine.

These organic amine type rust preventing agents are still insufficient in the rust prevention, and development of compounds having a higher rust preventive effect has been desired in the art.

The present inventors have made extensive and intensive research with a view to developing a rust preventing agent or anti-corrosive agent capable of showing a remarkable rust preventive effect to metals even when used in a small amount and being non-toxic, and as a result, it has been found that a saturated aliphatic triamine of 9 carbon atoms, having at each terminal position a primary amino group and being branched in the 4-position of the main chain, meets this object effectively. Representative examples of such specific organic triamines are 1,3,6-triaminomethylhexane and 1,2,3-triaminoethylpropane. It has also been found that derivatives of these organic triamines, such as addition products and condensation products, are also effective. Based on these findings, we have now made the present invention.

Therefore, in accordance with the present invention, there is provided an anti-corrosive agent for metals which comprises as an active component at least one member selected from the group consisting of a saturated aliphatic triamine of 9 carbon atoms having at each terminal position a primary amino group and branched in the 4-position of the main chain, and its addition products and condensation products. More specifically, according to the present invention, there is provided an anti-corrosive agent for metals which comprises as an active component at least one member selected from the group consisting of 1,3,6-triaminomethylhexane, 1,2,3-triaminoethylpropane, and their respective addition products and condensation products.

The anti-corrosive agent or the rust preventing agent of the present invention may be used in various forms.

When the anti-corrosive agent of this invention is used in the acid washing or pickling of metals, especially steel, it is dissolved or dispersed in an aqueous solution of an acid such as hydrochloric acid or sulfuric acid and the thus obtained solution of dispersion is used for preventing corrosion of metal. As this mode of use, there can be illustratively mentioned a case wherein in practicing various surface treatments such as plating, coating, lining, enamelling and the like, the substrate is subjected to a pre-treatment with an aqueous solution or dispersion of hydrochloric acid or sulfuric acid to remove the scales or rusts from the surface of the substrate, a case wherein before subjected to cold rolling, a hot coil is subjected to a continuous pickling with an aqueous solution or dispersion of hydrochloric acid or sulfuric acid to remove the scales of the coil, and a case wherein as a pre-treatment for detecting cracks of a casting, it is washed with an aqueous solution or dispersion of hydrochloric acid or sulfuric acid.

For the purpose of maintenance of a chemical apparatus in the chemical industry, the apparatus is usually washed with chemicals. In such case, the anti-corrosive agent of this invention can be effectively used. For example, when a boiler or heat-exchanger is washed with an acid, the present anti-corrosive agent is advantageously employed. Further, in the petroleum industry wherein the apparatus for production, storage and transportation, and the refining apparatus such as a distillation tower, platformer and the like are subject to corrosion, the anti-corrosive agent of this invention is advantageously added in petroleum so that the corrosion caused by inorganic salts, hydrogen sulfide, mercaptan and the like may be effectively prevented.

When the anti-corrosive agent of this invention is applied to a water-cooling column or to boiler water, it is dissolved or dispersed in water and the solution or dispersion is used for preventing corrosion of the material constituting the column or boiler. Further, the anti-corrosive agent of this invention is dissolved or dispersed water, an organic solvent or oil such as a lubricating oil and the so obtained solution or dispersion is coated on the surface of a metal to prevent corrosion of the metal in air.

As compounds capable of forming addition products and condensation products, which may be used in this invention, with 1,3,6-triaminomethylhexane or 1,2,3-triaminoethylpropane, there can be mentioned, for example, saturated fatty acids, unsaturated fatty acids, aliphatic hydroxycarboxylic acids, aromatic carboxylic acids, aromatic hydroxycarboxylic acids, natural oil fatty acids, polymers of unsaturated carboxylic acids, unsaturated fatty acid esters, unsaturated aliphatic nitriles, monoepoxides, amino acids and inorganic acids.

As the saturated fatty acid, there can be mentioned, for example, acetic acid, propionic acid, butyric acid, valeric acid, caproic acid, heptanoic acid, caprylic acid, pelargonic acid, capric acid, undecylenic acid, lauric acid, tridecylenic acid, myristic acid, pentadecylenic acid, palmitic acid, margaric acid, stearic acid, adipic acid, suberic acid, azelaic acid and sebacic acid.

As the unsaturated fatty acid, there can be mentioned, for example, acrylic acid, butenic acid, crotonic acid, isocrotonic acid, vinylacetic acid, methacrylic acid, pentenoic acid, hexenoic acid, teracrylic acid, hypogaeic acid, oleic acid, elaidic acid, linoleic acid, linoelaidic acid, eleostearic acid, linolenic acid, parinaric acid and arachidonic acid.

As the aliphatic hydroxycarboxylic acid, there can be mentioned, for example, glycolic acid, lactic acid and hydroxybutyric acid.

As the aromatic carboxylic acid, there can be mentioned, for example, benzoic acid, phenylacetic acid, phenylmethylacetic acid, cinnamic acid, phthalic acid, isophthalic acid, terephthalic acid, helimellitic acid, trimellitic acid, trimesic acid, benzene-polycarboxylic acid and naphthenic acid.

As the aromatic hydroxycarboxylic acid, there can be mentioned, for example, o-hydroxybenzoic acid and p-hydroxybenzoic acid.

As the natural oil fatty acid, there can be mentioned, for example, linseed oil fatty acid, olive oil fatty acid, cacao oil fatty acid, sesame oil fatty acid, rice bran oil fatty acid, soybean oil fatty acid, rapeseed oil fatty acid, palm oil fatty acid, castor oil fatty acid, cotton seed oil fatty acid, coconut oil fatty acid, peanut oil fatty acid, beef tallow oil fatty acid, sheep tallow oil fatty acid, sardine oil fatty acid and herring oil fatty acid.

As the unsaturated carboxylic acid polymer, there can be mentioned, for example, dimer acid, maleic acid-modified oleic acid, maleic acid-modified castor oil fatty acid and maleic acid-modified dimer acid.

As the unsaturated aliphatic nitrile, there can be mentioned, for example, acrylonitrile and methacrylonitrile.

As the unsaturated fatty acid ester, there can be mentioned, for example, methyl acrylate, ethyl acrylate, propyl acrylate, butyl acrylate, cyclohexyl acrylate, benzyl acrylate, 2-ethylhexyl acrylate, lauryl acrylate, stearyl acrylate, methoxyethyl acrylate, ethoxyethyl acrylate, 2-hydroxyethyl acrylate and corresponding esters of methacrylic acid.

As the monoepoxide, there can be mentioned, for example, oxide such as ethylene oxide, propylene oxide, octylene oxide and styrene oxide, glycidyl ethers such as butyl glycidyl ether and phenyl glycidyl ether, and glycidyl esters such as glycidyl acrylate and glycidyl methacrylate.

As the amino acid, there can be mentioned, for example, glycine, alanine, serine, cystine, aminobutyric acid, threonine, valine, methionine, leucine, phenylalanine, tyrosine, proline, tryptophane, glutamic acid and arginine.

As the inorganic acid, there can be mentioned, for example, hydrochloric acid, phosphoric acid, boric acid, sulfuric acid and nitric acid.

In order to obtain derivatives, namely addition products or condensation products derived from 1,3,6-triaminomethylhexane or 1,2,3-triaminoethylpropane which are also employable as an anti-corrosive agent according to the present invention, 1,3,6-triaminomethylhexane or 1,2,3-triaminoethylpropane is mixed with such a compound as recited above and then the reaction therebetween is effected while agitating. Two or more of compounds as recited above may be used for the synthesis of one derivative. The mixing condition and the reaction conditions vary depending on the kind of compound to be reacted with 1,3,6-triaminomethylhexane or 1,2,3-triaminoethylpropane. In case there are employed saturated fatty acids, aliphatic hydroxycarboxylic acids, aromatic carboxylic acids, aromatic hydroxycarboxylic acids, natural oil fatty acids, polymers of unsaturated carboxylic acids and/or amino acids, the mixing is effected at room temperature and the reaction is effected at about 150° to about 250° C. under a pressure of 0.01 to 10 kg/cm$^2$ for 2 to 30 hours. In case there are employed unsaturated fatty acids, unsaturated fatty acid esters, unsaturated fatty acid nitriles and/or monoepoxides, the mixing is effected at about 0° C. to room temperature (In this case, the mixing is exothermic and therefore it is necessary to cool the mixing system externally.) and the reaction is effected at about 30° to about 100° C. under atmospheric pressure for 2 to 10 hours. In case there are employed inorganic acid, the mixing is effected at room temperature and the reaction is effected at room temperature under atmospheric pressure for 0.5 to 5 hours.

In preparing the derivatives, it is preferred that 1,3,6-triaminomethylhexane or 1,2,3-triaminoethylpropane is employed in such an amount that the amount of the amine is equivalent to or excessive over the amount of the derivative-forming partner compound. If the amount of the derivative-forming partner compound such as a fatty acid is larger than the amount equivalent to that of the amine, the rust preventive effect of the obtained product is reduced. In other words, it is not desirable that the obtained product has functional groups remaining unreacted with the amine. Accordingly, use of the excessive amount of the derivative-forming partner compound is not preferred.

As stated before, the anti-corrosive agent of this invention is used in water, aqueous solutions of alkalis, aqueous solutions of acids, organic solvents and oils, and the application method is not particularly critical and it may be applied in the same manner as in the case of conventional anti-corrosive agents (See, for example "Corrosion Inhibitors" edited by C.C. Nathan and published by National Association of Corrosion Engineer. 1973).

The anti-corrosive agent of this invention may be applied to iron, aluminum, copper, other non-ferrous metals and alloys thereof in the form of a solution of dispersion having an active component concentration of 20 ppm or higher. There is not an upper critical concentration, but from a practical point of view there may usually be employed a concentration of up to about 1,000 ppm. The preferable lower limit of an effective concentration somewhat varies depending on the form of use. For example, in case the anti-corrosive agent is employed in the aqueous acid washing solution, the concentration is preferably at least about 20 to about 500 ppm.; in case it is employed in petroleum, at least about 20 ppm.; in case it is employed in the form of solution or dispersion in water, at least about 20 ppm.; in case it is employed in the form of a coating material, at least about 20 ppm.

The rust preventing agent or anti-corrosive agent of this invention has a much higher rust preventative effect than conventional organic amine type rust preventing agents. The reason has not been completely elucidated, but it is believed that this excellent effect may probably be owing to the fact that 1,3,6-triaminomethylhexane or 1,2,3-triaminoethylpropane is a branched polyamine having three highly basic primary amino groups in the molecule.

In general, it is considered that when an ordinary rust preventing agent is applied to the surface of a metal, the polar group in the chemical structure thereof is adsorbed on the metal surface while the hydrocarbon group is located apart from the metal surface and this hydrocarbon group exhibits a shielding effect of protecting the metal surface from a corrosive liquid or gas. Also in the anti-corrosive agent of this invention, it is construed that the rust preventive effect is exerted principally according to this mechanism.

This invention will now be described in detail by reference to the following Examples that by no means limit the scope of the invention. In these Examples, the corrosion prevention rate (CPR, %) was calculated according to the following formula:

$$CPR\ (\%) = \frac{CD_B - CD_A}{CD_B} \times 100$$

in which CRP denotes the corrosion prevention rate, $CD_B$ denotes the degree of corrosion at a blank test, and $CD_A$ denotes the degree of corrosion at a test using an anti-corrosive agent (The degree of corrosion is expressed in terms of "weight loss". ).

EXAMPLE 1

A test solution was prepared by dissolving 1,3,6-triaminomethylhexane in a 5% aqueous solution of sulfuric acid at a concentration of 50 ppm. A degreased mild steel plate, JIS G3141, having a size of 70 mm ×30 mm × 0.8 mm was immersed in the test solution and allowed to stand still at 25° C. for 7 days. Then, the degree of corrosion (the weight loss) was measured. The blank test was similarly conducted to determine the corrosion prevention rate was 96.0%.

EXAMPLE 2

A test solution was prepared by dissolving 1,2,3-triaminoethylpropane in a 5% aqueous solution of hydrochloric acid at a concentration of 80 ppm. A test piece as used in Example 1 was immersed in this test solution and allowed to stand still at 25° C. for 8 days. The corrosion prevention rate was determined in the same manner as in Example 1. It was found that the corrosion prevention rate was 97.9%.

EXAMPLE 3

At room temperature, 1.0 mole of 1,3,6-triaminomethylhexane was mixed with 1.0 mole of linoleic acid, and the mixture was reacted at 150° C. for 4 hours under agitation. After completion of the reaction, water formed by the reaction and the unreacted compounds were removed by distillation under reduced pressure. The condensation product was identified in the following manner:

The amide linkage was first analyzed by an infrared spectrograph. Then, the condensation product was dissolved in methanol and the unreacted 1,3,6-triaminomethylhexane was analyzed by gas chromatography. It was found that the content of the unreacted 1,3,6-triaminomethylhexane in the condensation product was lower than 0.2%.

A test solution was prepared by dissolving the so obtained condensation product in a 5% aqueous solution of hydrochloric acid at a concentration of 50 ppm. A test piece as used in Example 1 was immersed in this solution and allowed to stand still at 25° C. for 7 days. Then, the corrosion prevention rate was determined. It was found that the corrosion prevention rate was 99.87%. The metal surface had the same luster as before the immersion treatment, and even when it was taken out and placed in open air, formation of rust was not observed.

EXAMPLE 4

At room temperature, 1.0 mole of 1,3,6-triaminomethylhexane was mixed with 1.0 mole of stearic acid, and they were reacted at 180° C. for 5 hours under agitation. After completion of the reaction, water formed by the reaction and the unreacted compounds were removed by distillation under reduced pressure. The resulting condensation product was analyzed as follows:

The amide linkage was first analyzed by an infrared spectrograph. Then, the condensation product was dissolved in methanol and the unreacted 1,3,6-triaminomethylhexane was analyzed by gas chromatography. It was found that the content of the unreacted 1,3,6-triaminomethylhexane in the condensation product was lower than 0.3%.

A test solution was prepared by dissolving the so obtained condensation product in a 3% aqueous solution of sulfuric acid at a concentration of 70 ppm. A test piece as used in Example 1 was immersed in this solution and allowed to stand Still at 25° C. for 7 days. The corrosion prevention rate was determined. It was found that the corrosion prevention rate was 99.78%. The metal surface had the same luster as before the immersion treatment. Even when the test piece was taken out and placed in open air, formation of rust was not observed.

EXAMPLE 5

A test solution was prepared by dissolving 1,3,6-triaminomethylhexane in city service water (having a pH of 6.5) at a concentration of 1000 ppm. A test piece as used in Example 1 was immersed in this solution and allowed to stand still at 25° C. for 10 days. Formation of rust was not observed.

EXAMPLE 6

At room temperature, 1.0 mole of 1,3,6-triaminomethylhexane was mixed with 1.0 mole of lactic acid, and they were reacted at 100° C. for 3 hours under agitation. After completion of the reaction, water formed by the reaction and the unreacted compounds were removed by distillation under reduced pressure. The resulting condensation product was identified and confirmed in the same manner as described in Example 3. It was found that the content of the unreacted 1,3,6-triaminomethylhexane in the condensation product was 0.38%.

A test solution was prepared by dissolving the so obtained condensation product in city service water at a concentration of 50 ppm. A test piece as used in Example 1 was immersed in this solution and allowed to stand still at 25° C. for 10 days. Formation of rust was not observed.

EXAMPLE 7

At room temperature, 1.0 mole of 1,2,3-triaminoethylpropane was mixed with 1.0 mole of adipic acid, and they were reacted at 120° C. for 5 hours under agitation. After completion of the reaction, water formed by the reaction and the unreacted compounds were removed by distillation under reduced pressure. The resulting condensation product was identified and confirmed in the same manner as described in Example 3. It was found that the content of the unreacted 1,2,3-triaminoethylpropane in the condensation product was 0.45%.

A test solution was prepared by adding the so obtained condensation product to industrial water at a concentration of 600 ppm, and a test piece as used in Example 1 was immersed in the solution and allowed to stand still at 25° C. for 5 days. Formation of rust was not observed.

EXAMPLE 8

Under heating, 1.0 mole of 1,3,6-triaminomethylhexane was mixed with 1.0 mole of naphthenic acid, and they were reacted at 170° C. for 5 hours. After completion of the reaction, water formed by the reaction and the unreacted compounds were removed by distillation under reduced pressure.

The resulting condensation product was identified and confirmed in the same manner as described in Example 3. It was found that the content of the unreacted 1,3,6-triaminomethylhexane in the condensation product was 0.65%.

A test solution was prepared by adding the so obtained condensation product to turbine oil at a concentration of 800 ppm. Stainless steel, JIS SUS 27, having a size of 50 mm × 80 mm × 0.8 mm, was immersed in this test solution. The test piece was placed in a wet box, into which air maintained at a temperature of 49° C. and a relative humidity of 98% was blown. The test was conducted for 20 hours. Formation of rust was hardly observed.

EXAMPLE 9

At room temperature, 1.0 mole of 1,3,6-triaminomethylhexane was mixed with 0.4 mole of linseed oil fatty acid, and they were reacted at 150° C. for 5 hours. After completion of the reaction, water formed by the reaction and the unreacted compounds were removed by distillation under reduced pressure. The resulting condensation product was identified and confirmed in the same manner as described in Example 3. It was found that the content of the unreacted 1,3,6-triaminomethylhexane in the condensation product was 0.55%.

A test solution was prepared by adding the so obtained condensation product to a 3% aqueous solution of hydrochloric acid at a concentration of 100 ppm. A test piece as used in Example 1 was immersed in this test solution and allowed to stand still at 25° C. for 7 days. The corrosion prevention rate was determined. It was found that the corrosion prevention rate was 98.9%.

EXAMPLE 10

At room temperature, 1.0 mole of 1,3,6-triaminomethylhexane was mixed with 2.0 moles of acrylonitrile, and they were reacted at 70° C. for 3 hours. After completion of the reaction, the unreacted compounds were removed by distillation under reduced pressure. The resulting addition product or adduct was separated by liquid chromatography, and the main product was identified by using an infrared spectrograph to confirm formation of the intended adduct. Further, the product was subjected to a mass spectrum analysis to determine the molecular weight. As a result of gas chromatography, it was found that the contents of the unreacted 1,3,6-triaminomethylhexane and acrylonitrile in the adduct were 0.85% and 0.15%, respectively.

A test solution was prepared by adding the so obtained adduct to city service water at a concentration of 80 ppm. A copper plate, JIS H3101, having a size of 70 mm × 40 mm × 0.5 mm, was immersed in this solution and allowed to stand still at 25° C. for 3 days. No substantial change was observed on the plate surface.

EXAMPLE 11

At room temperature, 1.0 mole of 1,2,3-triaminoethylpropane was mixed with 0.8 mole of ethyl acrylate, and they were reacted at 60° C. for 5 hours. After completion of the reaction, the unreacted compounds were removed by distillation under reduced pressure. The resulting adduct was analyzed and confirmed in the same manner as described in Example 10. As a result of gas chromatography, it was found that the contents of the unreacted 1,2,3-triaminoethylpropane and ethyl acrylate in the resulting adduct were 1.2% and 0.2%, respectively.

A test solution was prepared by adding the so obtained adduct to city service water at a concentration of 60 ppm. A test piece as used in Example 8 was immersed in this test solution and allowed to stand still at 25° C. for 10 days. Formation of rust was hardly observed.

EXAMPLE 12

At 70° C., 0.5 mole of propylene oxide was added dropwise to 1.0 mole of 1,3,6-triaminomethylhexane to effect reaction therebetween. After completion of the reaction, the unreacted compounds were removed by distillation under reduced pressure. The adduct was analyzed and confirmed in same manner as described in Example 10. As a result of gas chromatography, it was found that the contents of the unreacted 1,3,6-triaminomethylhexane and propylene oxide in the resulting adduct were 0.9% and 0.05%, respectively.

A test solution was prepared by adding the so obtained adduct to city service water at a concentration of 300 ppm, and an aluminum plate, JIS H4101, was immersed in this test solution and allowed to stand still at 25° C. for 2 days. No change was observed on the plate surface.

EXAMPLE 13

At room temperature, 1.0 mole of 1,3,6-triaminomethylhexane was mixed with 1.5 mole of butyl glycidyl ether, and they were reacted at 50° C. for 5 hours. After completion of the reaction, the unreacted compounds were removed by distillation under reduced pressure. The resulting adduct was analyzed and confirmed in the same manner as described in Example 10. As a result of gas chromatography, it was found that the contents of unreacted 1,3,6-triaminomethylhexane and butyl glycidyl ether in the adduct were 0.8% and 0.6%, respectively.

A test solution was prepared by adding the so obtained adduct to a 3% aqueous solution of sulfuric acid at a concentration of 100 ppm. A test piece as used in Example 1 was immersed in this test solution and allowed to stand still at 25° C. for 8 hours. The corrosion prevention rate was found to be 98.7%.

EXAMPLE 14

At 50° C., 1.0 mole of 1,3,6-triaminomethylhexane was reacted with 1.0 mole of hydrochloric acid under agitation. After completion of the reaction, the reaction product was dried in vacuo and recrystallized from a mixed solvent of benzene and methanol. The resulting salt was analyzed and confirmed in the same manner as described in Example 10. The content of the unreacted 1,3,6-triaminomethylhexane in the resulting salt was 0.7%.

A test solution was prepared by adding the so obtained salt to industrial water at a concentration of 300 ppm. A test piece as used in Example 1 was immersed in this test solution and allowed to stand still at 25° C. for 10 days. Formation of rust was not observed.

EXAMPLE 15

A test solution was prepared by adding an amine or amine derivative shown in Table 1 to a 3% aqueous solution of hydrochloric acid at a concentration of 50 ppm. A mild steel plate, JIS G3141, having a size of 70 mm × 30 mm × 0.8 mm, was immersed in this test solution and allowed to stand still for 7 days. The corrosion prevention rate was determined to obtain results shown in Table 1.

Table 1

| Rust Preventive Agent | Corrosion Prevention Rate (%) |
|---|---|
| 1,3,6-triaminomethylhexane (this invention) | 98.5 |
| 1,3,6-triaminomethylhexane-linoleic acid condensation product (this invention) | 99.7 |
| n-hexylamine (conventional agent) | 74.2 |
| triethylene tetramine (conventional agent) | 68.5 |
| n-dodecylamine (conventional agent) | 79.5 |
| hexamethylene diamine (conventional agent) | 65.8 |

As will be apparent from the results shown in Table 1, the rust preventive agent of this invention has a much higher corrosion prevention rate than conventional amine type rust preventive agents.

EXAMPLE 16

Under heating, 1.0 mole of 1,3,6-triaminomethylhexane was mixed with 1.0 mole of o-hydroxybenzoic acid, and they were reacted at 200° C. for 5 hours. After completion of the reaction, the unreacted compounds were removed by distillation under reduced pressure. The resulting condensation product was analyzed and confirmed in the same manner as described in Example 3. The contents of the unreacted 1,3,6-triaminomethylhexane and o-hydroxybenzoic acid in the resulting condensation product were 0.8% and 1.9%, respectively.

A test solution was prepared by adding the so obtained condensation product to a 5% aqueous solution of hydrochloric acid at a concentration of 500 ppm. A test piece as used in Example 1 was immersed in this test solution and allowed to stand still at 70° C. for 3 hours. The corrosion prevention rate was found to be 97.8%.

EXAMPLE 17

At 180° C., 0.5 mole of dimer acid was added dropwise to 1.0 mole of 1,2,3-triaminoethylpropane over a period of 5 hours to effect reaction therebetween. After completion of the reaction, water formed by the reaction and the unreacted compounds were removed by distillation under reduced pressure. The resulting condensation product was analyzed and confirmed in the same manner as described in Example 3. The content of the unreacted 1,2,3-triaminoethylpropane in the condensation product was 0.7%.

A test solution was prepared by adding the so obtained condensation product to a 5% aqueous solution of sulfuric acid at a concentration of 300 ppm. A test piece as used in Example 1 was immersed in this test solution and allowed to stand still at 25° C. for 7 days. The corrosion prevention rate was found to be 98.2%.

EXAMPLE 18

Under heating, 1.0 mole of 1,3,6-triaminomethylhexane was mixed with 1.0 mole of glycine, and they were reacted at 220° C. for 6 hours. After completion of the reaction, the unreacted compounds were removed by distillation under reduced pressure. The resulting condensation product was analyzed and confirmed in the same manner as described in Example 3. The content of the unreacted 1,3,6-triaminomethylhexane in the resulting condensation product was 0.8%.

A test solution was prepared by adding the so obtained condensation product to industrial water at a concentration of 800 ppm. A test piece as used in Example 1 was immersed in this test solution and allowed to stand still at 25° C. for 7 days. Formation of rust was hardly observed.

What is claimed is:

1. A method of inhibiting corrosion of metal surfaces comprising applying to a metal surface a solution or dispersion containing an effective concentration of at least one condensation product of a saturated aliphatic triamine of 9 carbon atoms having a main chain which is branched at the 4-position and having a primary amino group at each carbon atom in a terminal position and at least one member selected from the group consisting of saturated fatty acids, aliphatic hydroxycarboxylic acids, aromatic carboxylic acids, aromatic hydroxycarboxylic acids, natural oil fatty acids, polymers of unsaturated carboxylic acids and amino acids.

2. A method according to claim 1 in which the triamine is at least one member selected from the group consisting of 1,3,6-triaminomethylhexane, 1,2,3-triaminoethylpropane and a mixture thereof.

3. A method according to claim 1 in which the saturated fatty acids are acetic acid, propionic acid, butyric acid, valeric acid, caproic acid, heptanoic acid, caprylic acid, pelargonic acid, capric acid, undecylenic acid, lauric acid, tridecylenic acid, myristic acid, pentadecylenic acid, palmitic acid, margaric acid, stearic acid, adipic acid, suberic acid, azelaic acid and sebacic acid.

4. A method according to claim 1 in which the aliphatic hydroxycarboxylic acids are glycolic acid, lactic acid and hydroxybutyric acid.

5. A method according to claim 1 in which the aromatic caroboxylic acids are benzoic acid, phenylacetic acid, phenylmethylacetic acid, cinnamic acid, phthalic acid, isophthalic acid, terephthalic acid, helimellitic acid, trimellitic acid, trimesic acid, benzene-polycarboxylic acid and napthenic acid.

6. A method according to claim 1 in which the aromatic hydroxycarboxylic acids are o-hydroxybenzoic acid and p-hydroxybenzoic acid.

7. A method according to claim 1 in which the natural oil fatty acids are linseed oil fatty acid, olive oil fatty acid, cacao oil fatty acid, sesame oil fatty acid, rice bran oil fatty acid, soybean oil fatty acid, rapeseed oil fatty acid, palm oil fatty acid, castor oil fatty acid, cotton seed oil fatty acid, coconut oil fatty acid, peanut oil fatty acid, beef tallow oil fatty acid, sheep tallow oil fatty acid, sardine oil fatty acid and herring oil fatty acid.

8. A method according to claim 1 in which the polyners of unsaturated carboxylic acids are dimer acid, maleic acid-modified oleic acid, maleic acid-modified castor oil fatty acid and maleic acid-modified dimer acid.

9. A method according to claim 1 in which the amino acids are glycine, alanine, serine, cystine, aminobutyric acid, threonine, valine, methionine leucine, phenylalanine, tyrosine, proline, tryptophane, glutamic acid and arginine.

10. A method according to claim 1 in which the concentration of condensation product is at least 20 ppm.

11. A method according to claim 10 in which the concentration is 20–1000 ppm.

12. A method according to claim 1 in which the metal surface is iron, aluminum, copper or an alloy thereof, whereby the formation of rust is prevented on the metal surface.

13. A method according to claim 1 in which the condensation product is dissolved or dispersed in water, in aqueous acid or alkali, in an organic solvent or in oil.

* * * * *